US005375808A

United States Patent [19]

Roy

[11] Patent Number: 5,375,808

[45] Date of Patent: Dec. 27, 1994

[54] STAND FOR QUICKLY ERECTING AND STRAIGHTENING CHRISTMAS TREES

[76] Inventor: Michael D. Roy, 307 41st Ave., NE., Olympia, Wash. 98506

[21] Appl. No.: 94,242

[22] Filed: Jul. 19, 1993

[51] Int. Cl.[5] ..... F16M 13/00

[52] U.S. Cl. ..... 248/523; 47/40.5

[58] Field of Search ..... 248/523, 524, 528, 519; 47/40.5, 42

[56] References Cited

U.S. PATENT DOCUMENTS

| | | | |
|---|---|---|---|
| 535,887 | 3/1895 | Brown | 248/523 |
| 2,485,233 | 10/1949 | Cima | 248/524 |
| 2,628,798 | 2/1953 | Kass | 248/524 |
| 2,639,877 | 5/1953 | Fox | 248/523 X |
| 2,703,213 | 3/1955 | Zamierowski | 248/524 X |
| 2,786,641 | 3/1957 | Applegate | 248/523 |
| 3,901,469 | 8/1975 | Davis et al. . | |
| 4,399,973 | 8/1983 | Spry et al. . | |
| 4,569,151 | 2/1986 | Hoffbeck . | |
| 4,699,347 | 10/1987 | Kuhnley | 47/40.5 X |
| 4,901,971 | 2/1990 | Connelly . | |
| 4,936,538 | 6/1990 | Royce | 47/40.5 X |
| 4,976,411 | 12/1990 | Gordon et al. . | |
| 5,249,772 | 10/1993 | Montie | 47/40.5 X |

FOREIGN PATENT DOCUMENTS

| | | | |
|---|---|---|---|
| 613012 | 4/1935 | Germany | 248/524 |

OTHER PUBLICATIONS

Ad entitled "The Davis Christmas Tree Stands" (undated).

Ad entitled "Increase Your Christmas Profits" (undated).

Ad entitled "The World's Fastest Tree Stand" (undated).

*Primary Examiner*—J. Franklin Foss

*Attorney, Agent, or Firm*—Chernoff, Vilhauer, McClung & Stenzel

[57] ABSTRACT

A Christmas tree stand has a base having a jaw assembly with a bottom for slidably engaging a tree trunk and a bar, above the bottom of the jaw assembly, for forcibly clamping the trunk laterally between the bar and jaw assembly. The bar member is preferably relatively stiff but resiliently bendable, and pivotally attached to the base so as to be movable selectively toward or away from the tree trunk laterally. The bar is lockable in variable positions relative to the base in tight engagement with trunks of differing diameters. After the bar is locked, the tree is easily straightened by grasping an upper portion of the trunk and moving it laterally, causing the bottom of the trunk to slide laterally across the bottom of the jaw assembly while the bar acts as a fulcrum about which the trunk pivots.

15 Claims, 5 Drawing Sheets

STAND FOR QUICKLY ERECTING AND STRAIGHTENING CHRISTMAS TREES

BACKGROUND OF THE INVENTION

The present invention is directed to a tree stand system for quickly and easily erecting a Christmas tree, straightening the tree, and later removing it.

Many tree stand designs have been proposed in the past for erecting and displaying Christmas trees both for home use and commercial use. These are exemplified by the stands shown in U.S. Pat. Nos. 3,901,469, 4,399,973, 4,569,151, 4,699,347, 4,901,971, and 4,976,411, as well as by a stand sold previously under the trademark GRANDSTAND and sometimes referred to as "The Davis Christmas Tree Stand." All of these prior stands provide means for supporting a tree in an upright position and for permitting the tree to be straightened relative to the stand. Some or these stands, notably those having spring elements for engaging the trunk of the tree, enable relatively quick erection and straightening of the tree, but do not provide particularly reliable and firm engagement capable of maintaining trees, particularly heavy ones, in proper position over an extended period of time under external influences such as bumping or wind. On the other hand, those prior stands having firmer and less resilient trunk-engaging members, and which are capable of holding and maintaining both light and heavy trees alike in proper position over an extended period of time, do not enable as easy or quick erection and straightening as do the stands mentioned above.

SUMMARY OF THE INVENTION

It is a primary objective of the present invention to provide a Christmas tree stand system which enables quick and easy erection and straightening of a tree on the stand, and yet provides an extremely firm trunk-engaging structure for reliably maintaining both light and heavy trees in proper position on the stand over an extended period of time.

The present invention accomplishes this objective by providing a Christmas tree stand having a ground-engaging base with a vertically-oriented jaw assembly for engaging the side surface of the trunk and a movable bar located above the bottom of the jaw assembly for forcibly pushing the trunk laterally against the jaw assembly. In one important aspect of the invention, the bar is resiliently bendable and selectively lockable in different positions relative to the base in tight bendable engagement with the side of the trunk. In a second important aspect of the invention, the bar is selectively pivotable about an axis toward and away from the jaw assembly and selectively lockable in different pivotable positions relative to the base in tight engagement with the side of the trunk.

The bottom of the jaw assembly slidably engages the trunk, which permits the trunk to be grasped at a position above the locked bar and moved laterally, causing the bottom of the trunk to slide laterally across the bottom of the jaw assembly with the bar acting as a fulcrum about which the trunk pivots to enable quick and easy straightening of the tree.

Also, preferably, the movement of the bar to lockably engage the side of the trunk is accomplished merely by applying foot pressure to the bar.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 7:
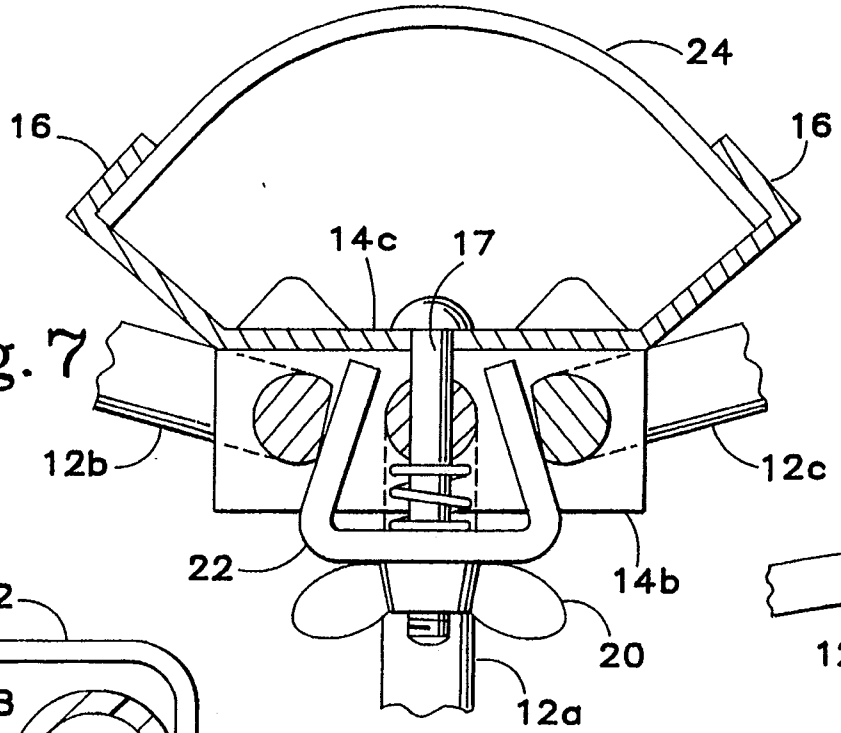
FIG. 7 is an enlarged partially sectional view taken line 7—7 of FIG. 6.

A preferred embodiment of the tree stand of the present invention, indicated generally as 10, comprises a base composed of three ground-engaging legs 12*a*, 12*b*, 12*c* joined together by a central jaw assembly 14. The jaw assembly 14 comprises a pair of vertically-spaced, horizontally-extending plates 14*a* and 14*b* joined together by a web 14*c* and having a pair of vertically oriented jaw members 16 affixed thereto. One of the legs 12*a* is fixedly attached to the plates 14*a*, 14*b* by a screw 17 which passes diametrically through a portion of the leg 12*a* as best shown in FIG. 7. The other two legs 12*b* and 12*c* are connected pivotally to the plates 14*a*, 14*b* so as to be capable of rotating relative to the leg 12*a* from their positions shown in FIG. 2 to the more compact folded positions shown in FIG. 3 for storage purposes. Pins 18 prevent the legs 12*b* and 12*c* from being withdrawn from the plates 14*a*, 14*b*. The legs 12*b* and 12*c* are selectively lockable and unlockable in their respective pivotable positions by means of a wing nut 20 which selectively tightens or loosens the engagement between a spring-biased wedge member 22 and the respective legs 12*b* and 12*c*.

Rigidly affixed to the bottoms of the jaw members 16 and constituting part of the bottom of the jaw assembly 14 is a member 24 upon which a tree trunk 26 may rest for vertical support. Both the member 24 and the bottoms of the vertical jaw members 16 engage the bottom surfaces of the trunk 26 frictionally without penetrating the trunk surfaces, so that the bottom of the trunk 26 can slide laterally across the bottom of the jaw assembly 14 for reasons to be described hereafter. Although it is preferable to provide both lateral frictional trunk engagement by means of the bottoms of the jaw members 16, and vertical frictional trunk engagement by means of the member 24, it is unnecessary to provide both types of engagement at the bottom of the jaw assembly and one or the other may be deleted without adversely affecting the operability of the stand.

Figure 2:
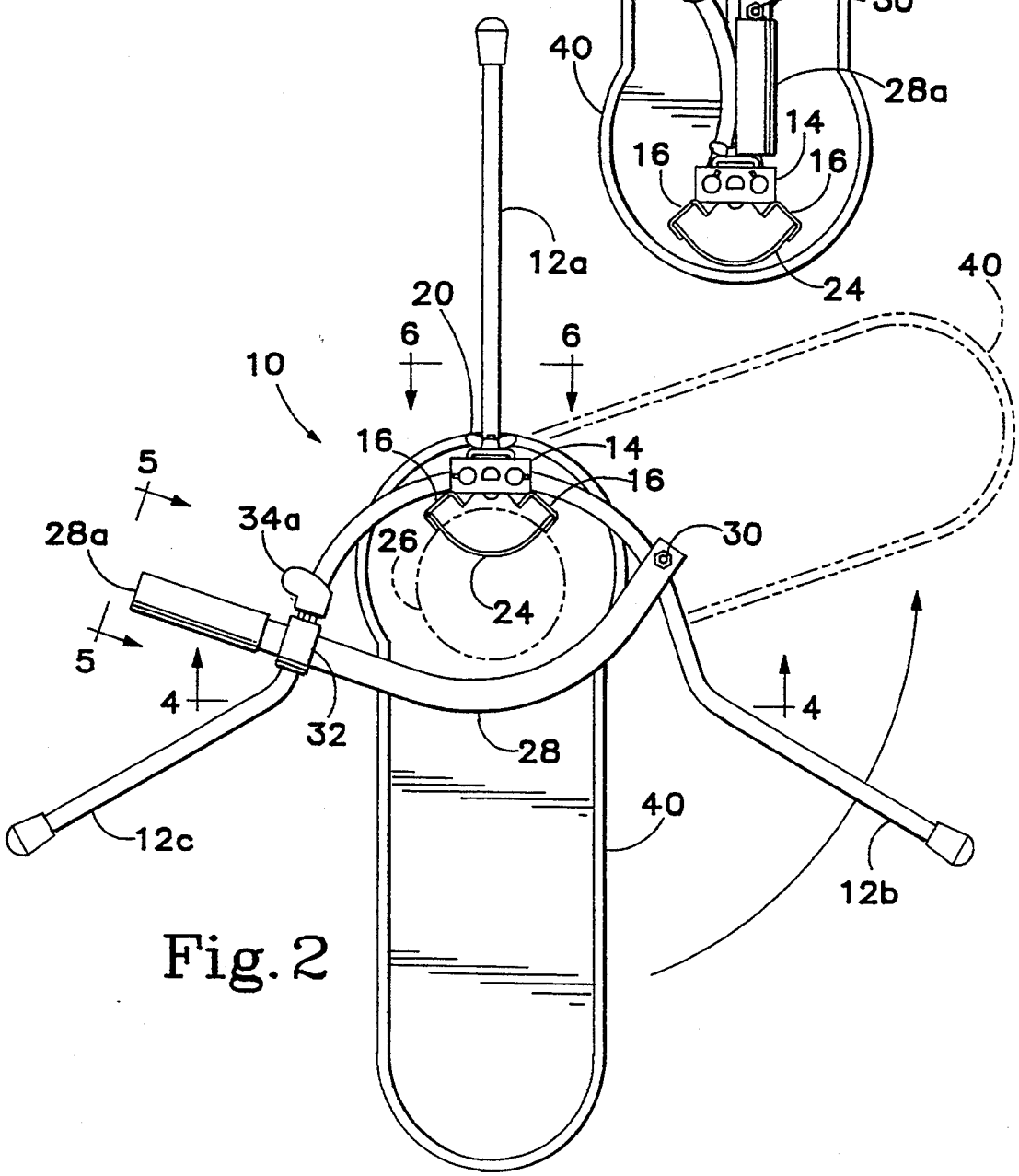
FIG. 2 is a top view of the stand of FIG. 1.
Figure 6:
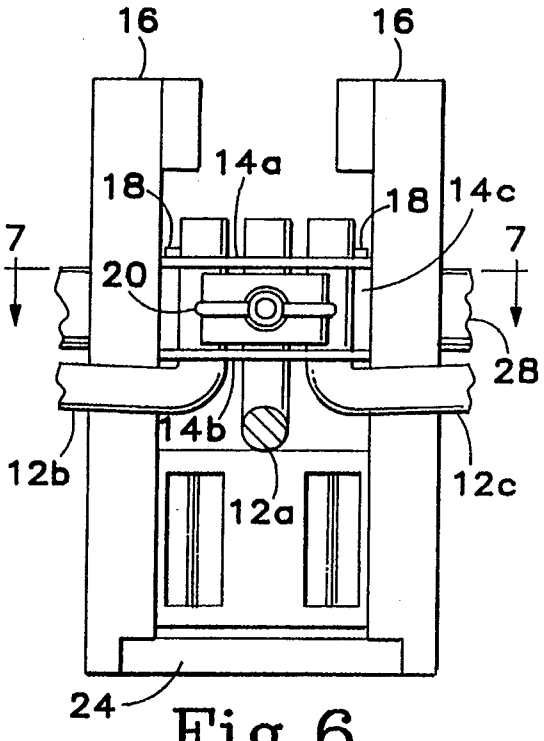
FIG. 6 is an enlarged partially sectional view taken along line 6—6 of FIG. 2.
Figure 5:
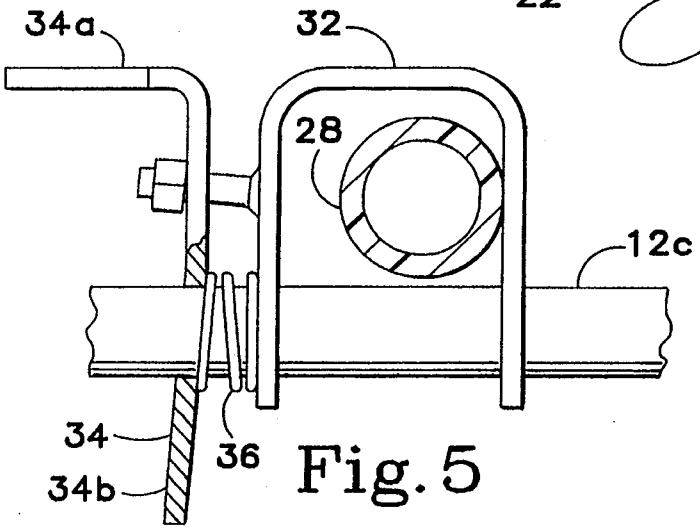
FIG. 5 is an enlarged partially sectional view taken along line 5—5 of FIG. 2.

Above the bottom of the jaw assembly 14 and cooperating with the jaw members 16 is a stiff but somewhat resiliently bendable bar 28 having a normally unstressed nonlinear shape forming a generally rounded obtuse angle as shown in FIG. 2. The bar is pivotally connected by a vertical bolt and nut pivot assembly 30 to the leg 12*b* so as to pivot about a substantially vertical axis selectively toward or away from the jaw members 16. The bar 28 is preferably composed of hollow PVC tubing or similar stiff but resiliently bendable material. The end of the bar 28 opposite to the pivot assembly 30 passes loosely through a clevis 32 slidably mounted on the leg 12*c*. As best shown in FIG. 5, the clevis has a conventional spring-biased lock 34 connected thereto which allows the clevis to slide freely along the leg 12*c* to the left as shown in FIG. 5, but automatically prevents the clevis from sliding in the opposite direction along the leg 12*c* unless the unlocking lever 34*a* of the lock 34 is depressed downwardly against the force of the locking spring 36.

Figure 3:
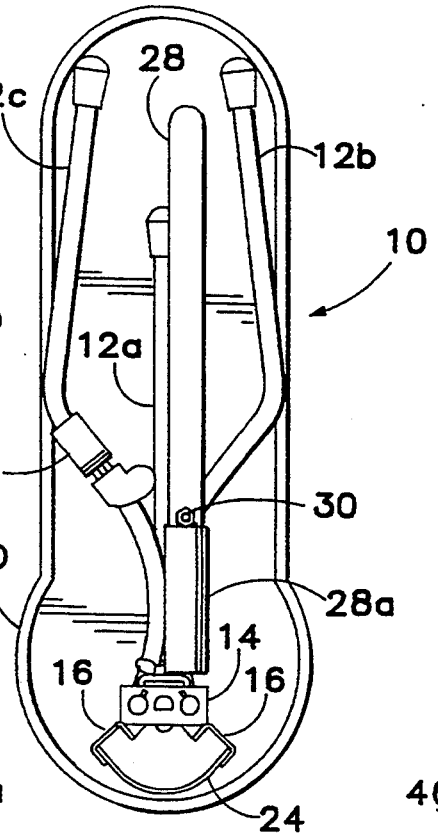
FIG. 3 is a top view of the stand of FIG. 1 shown in folded condition for storage.
Figure 4:
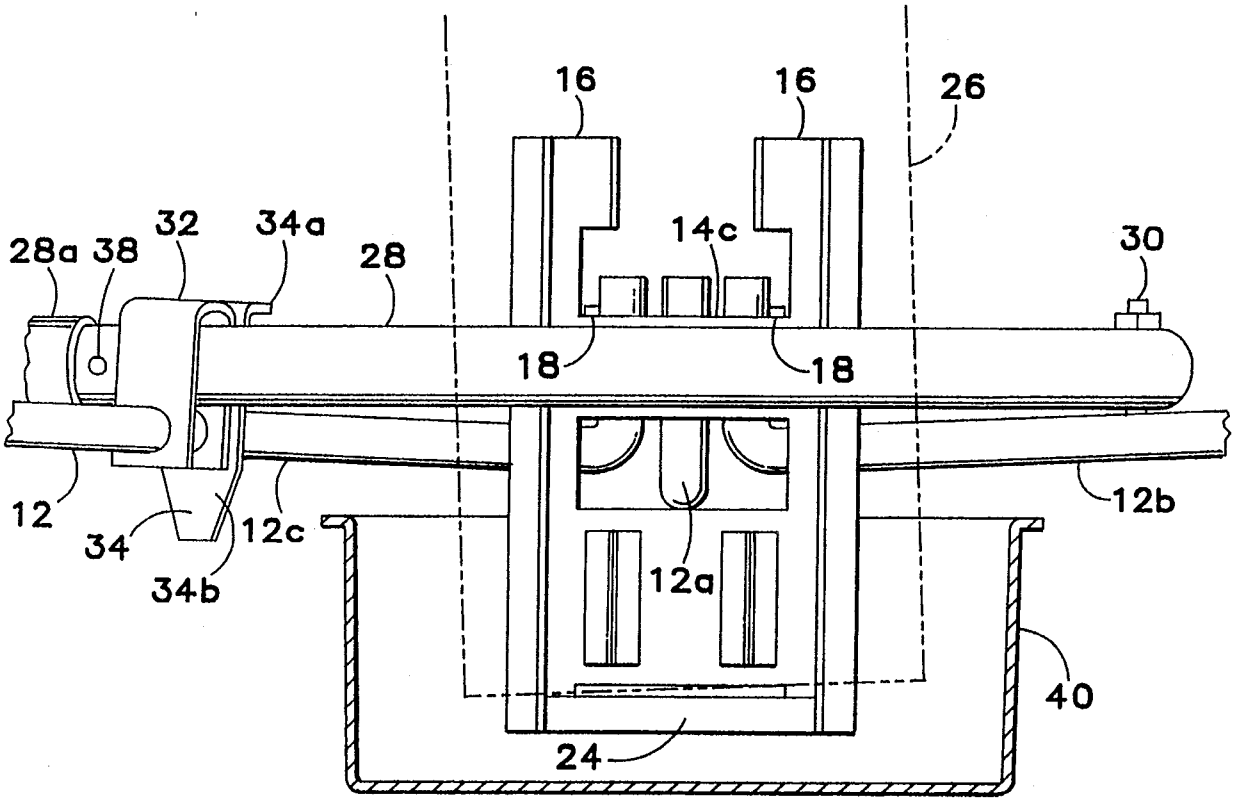
FIG. 4 is an enlarged partially sectional view taken along line 4—4 of FIG. 2.
Figure 8:
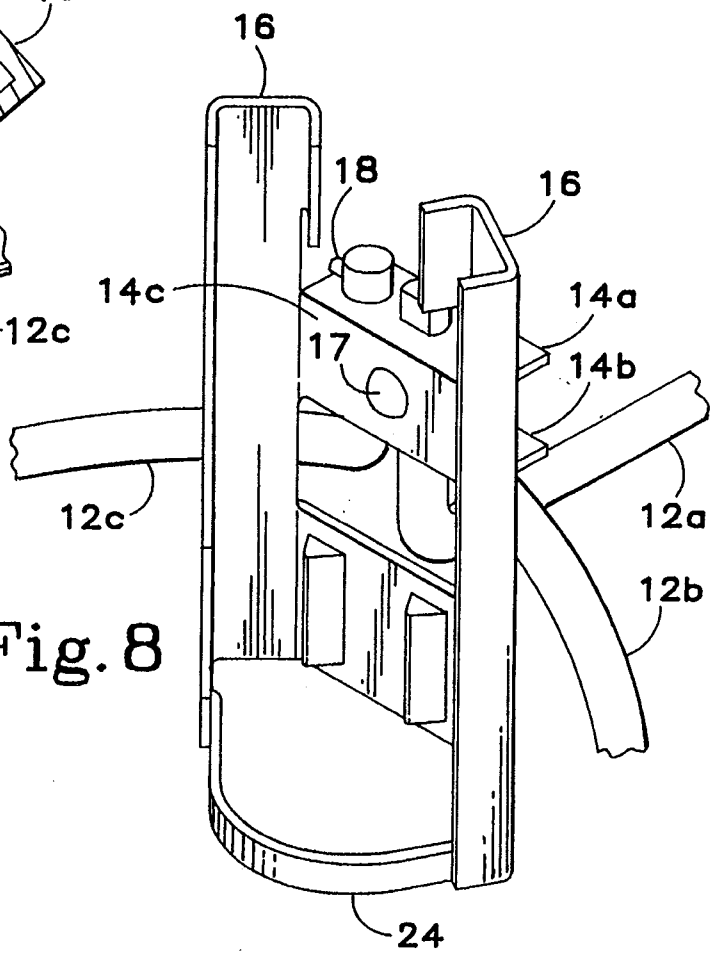
FIG. 8 is an enlarged perspective view of a central portion of the stand of FIG. 1.

To fold the stand into the compact storage position shown in FIG. 3, the nut of the pivot assembly 30 is removed and the bar 28 is detached therefrom and reattached to the same pivot assembly 30 through a diametric hole 38 (FIG. 4) passing through the bar 28 at a radial orientation 90° displaced from the orientation of the operative pivot hole at the opposite end of the bar 28.

Figure 1:
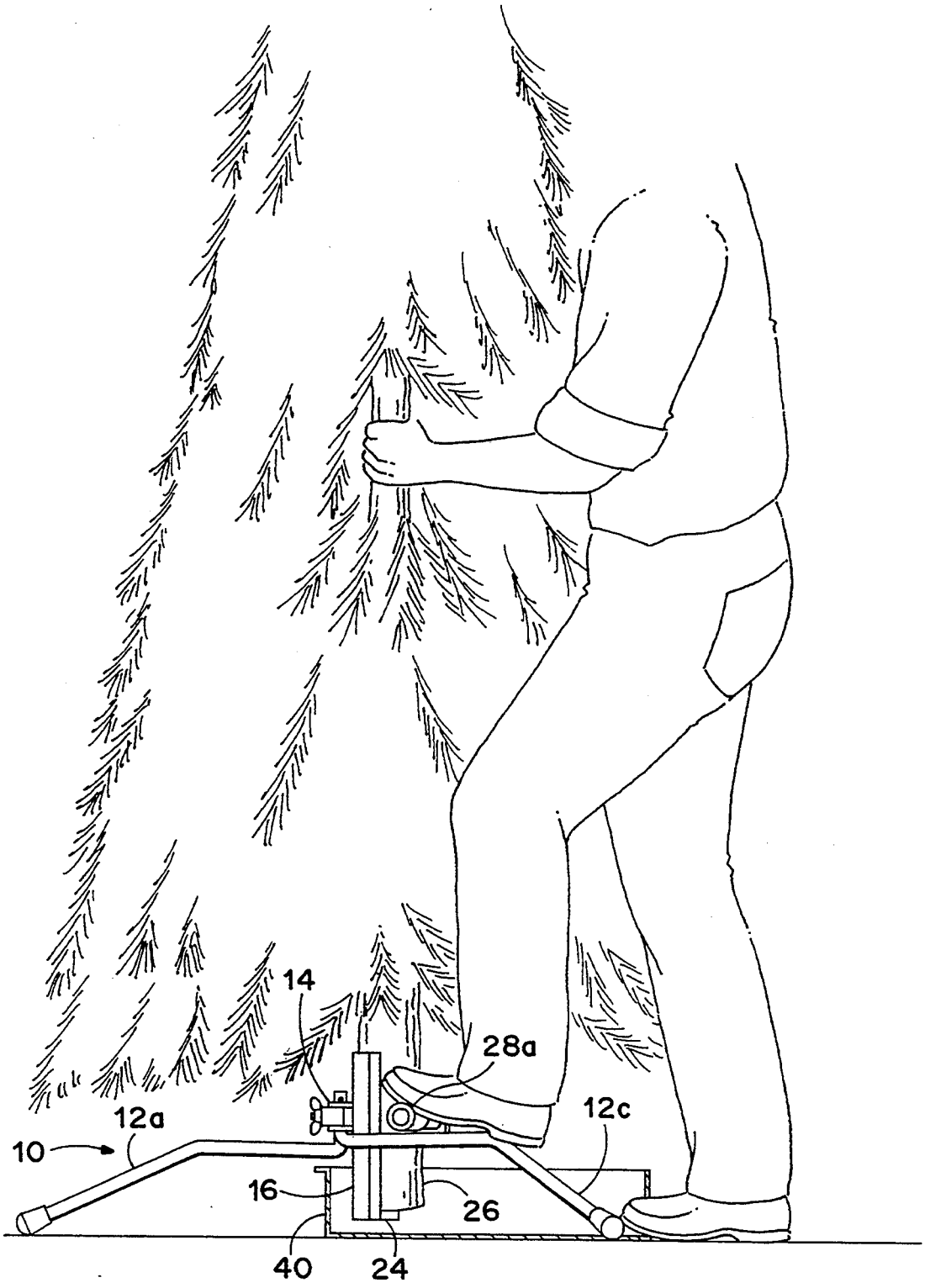
FIG. 1 is a side view of an exemplary embodiment of the tree stand of the present invention, shown in operation during the erection of a Christmas tree.
Figure 9:
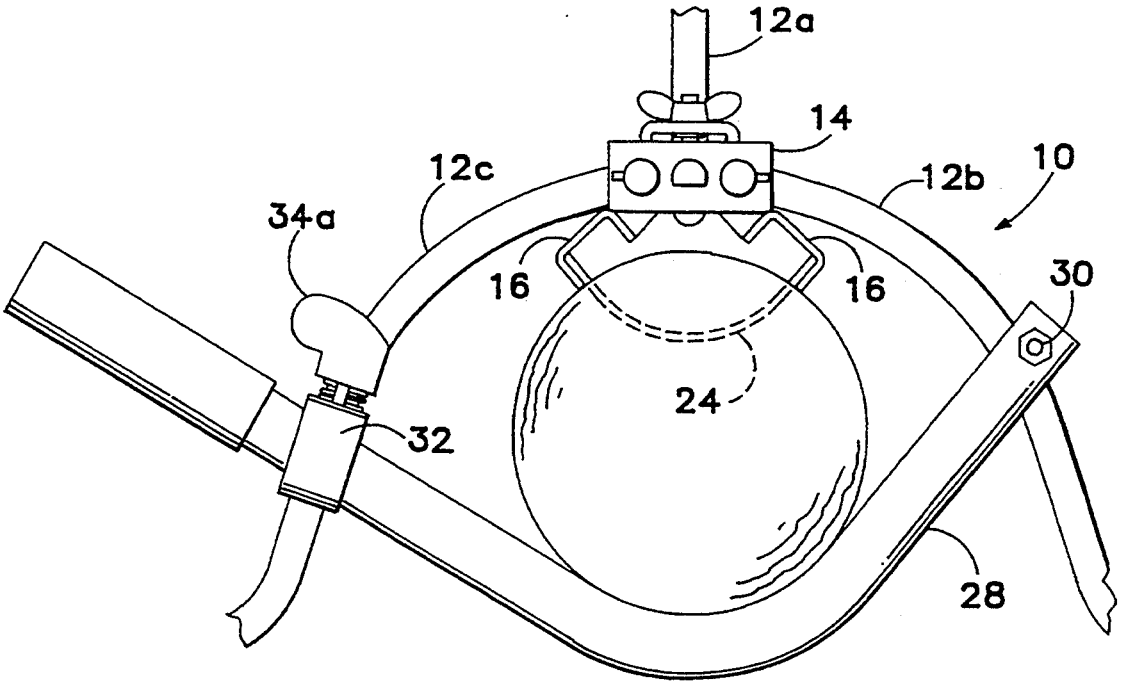
FIG. 9 is a partial top view of the stand of FIG. 1 shown engaging a relatively large diameter tree trunk.
Figure 10:
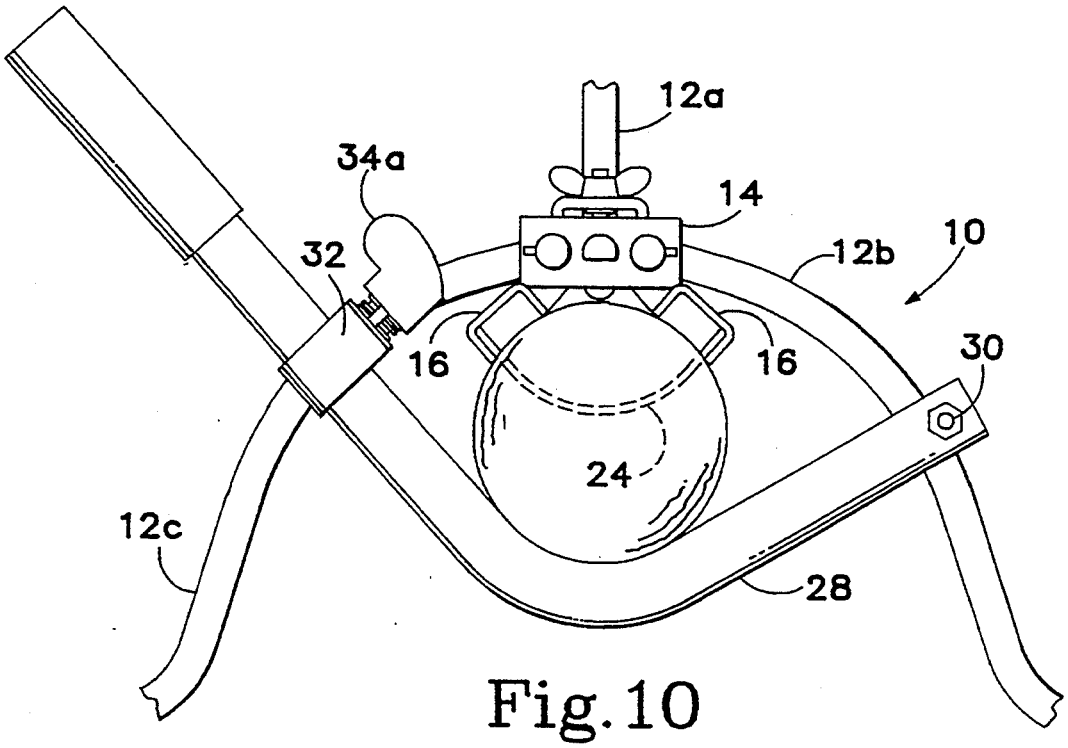
FIG. 10 is a partial top view of the stand of FIG. 1 shown engaging a relatively small diameter tree trunk.

To use the stand 10, the legs are unfolded from their storage positions as shown in FIG. 3 by pivoting them to their operative positions shown in FIG. 2 after which the wing nut 20 is tightened to fasten the legs in their operative positions. The nut of the pivot assembly 30 is removed to detach the bar 28, and the bar is passed through the clevis 32 and reattached to the pivot assembly 30 in the position shown in FIG. 2. A water vessel 40 of any suitable type, but preferably of elongate shape as shown in the figures, is placed below the stand in a suitable position as shown in FIG. 2 so that the elongated end of the vessel protrudes outwardly from beneath the stand to a location easily reached by a hose or watering can. The trunk 26 of the tree is inserted vertically downward between the bar 28 and the jaw members 16 until its bottom surface rests atop the member 24. Then, while grasping an upper portion of the trunk, the user places his foot on the end 28*a* of the bar as shown in FIG. 1 and pushes the bar pivotally toward the jaw members 16 while the lock 34 freely permits the clevis 32 to slide along the leg 12*c* toward the jaw members in response to the user's foot pressure. The resilient nature of the bar 28 permits the bar to bend resiliently about the trunk under the foot pressure as the bar tightly clamps the tree trunk between the jaw members 16 and bar so that the normal unstressed obtuse angle of the bar is somewhat reduced. The bar 28 is automatically prevented from retracting from its tightened condition by the lock 34 when the foot pressure is removed. After the bar is in its tightened condition, the user moves the upper portion of the trunk laterally in any desired direction while pressing his foot on one leg of the stand to steady it, until he is satisfied that the tree is straight. As the upper portion of the tree trunk moves laterally, the bottom surfaces of the trunk slide frictionally laterally across the bottom of the jaw assembly 14 with the bar 28 acting as a fulcrum about which the tree trunk pivots. The frictional engagement of the bottom surfaces of the trunk with the bottom of the jaw assembly, coupled with the tight lateral gripping of the tree trunk between the jaw members 16 and the bar 28, thereafter reliably maintains the tree in its straight position indefinitely, regardless of normal external influences such as wind or bumping, and regardless of whether the tree is heavy or light. FIGS. 9 and 10 depict exemplary positions of the tightened bar 28 as it grips a larger diameter trunk (FIG. 9) or a smaller diameter trunk (FIG. 10).

To remove the tree from the stand, the user simply applies his foot to the top of the unlocking lever 34*a* to depress it, which loosens the lock 34 and permits the clevis 32 to slide in the opposite direction along the leg 12*c* to loosen the bar 28. The tree trunk is then removed upwardly from the stand.

Alternatively, tightening and unlocking of the bar 28 can be accomplished by hand instead of foot actuation, if desired. In the case of unlocking, thumb pressure can be applied against the lower portion 34*b* of the lock 34 to release the lock.

Preferably, the shape of the vessel 40 is such as to matingly enclose the stand when in its folded condition as shown in FIG. 3, with the end of the folded stand containing the jaw assembly 14 being located at the wider end of the vessel 40.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A Christmas tree stand comprising:

(a) a ground-engaging base for supporting the trunk of a Christmas tree;

(b) a jaw assembly on said ground-engaging base for laterally supporting said trunk by engaging a side thereof, said jaw assembly having both a top portion and a bottom portion;

(c) bar means on said ground-engaging base located above said bottom portion of said jaw assembly for laterally supporting said trunk by forcibly engaging the side thereof when said trunk is located between said bar means and said top portion of said jaw assembly, said bar means being movably mounted on said base so as to be selectively movable laterally toward and away from said top portion of said jaw assembly and being selectively lockable in different positions relative to said base in tight engagement with the side of said trunk; and (d) said bottom portion of said jaw assembly being supported vertically by said ground-engaging base and including means for slidably and supportably engaging the bottom extremity of said trunk so as to permit said trunk to slide laterally across said bottom portion of said jaw assembly while being supported thereby and while said bar means is locked in said tight engagement with the side of said trunk.

2. The apparatus of claim 1 wherein said bar means and said top portion of said jaw assembly comprise fulcrum means for enabling said trunk to pivot about said bar means as said bottom extremity of said trunk slides laterally across said bottom portion of said jaw assembly.

3. The apparatus of claim 1 wherein said bar means is resiliently bendable.

4. The apparatus of claim 1 wherein said bar means is formed of bendable plastic.

5. The apparatus of claim 1 wherein said bar means is formed nonlinearly so as to include an obtuse angle.

6. The apparatus of claim 1 wherein said bar means is pivotally mounted on said base so as to pivot about an axis selectively toward and away from said top portion of said jaw assembly.

7. A Christmas tree stand comprising:

(a) a ground-engaging base for supporting the trunk of a Christmas tree;

(b) a jaw assembly on said ground-engaging base for laterally supporting said trunk by engaging a side thereof;

(c) bar means on said base for laterally supporting said trunk by forcibly engaging the side thereof when said trunk is located between said bar means and said jaw assembly, said bar means being resiliently bendable and movably mounted on said base so as to be selectively movable laterally toward and away from said jaw assembly, and being selectively bendably lockable in different positions relative to said base in tight engagement with the side of said trunk; and (d) said bar means and jaw assembly comprising fulcrum means for enabling said trunk to pivot about said bar means during said tight engagement so that the bottom extremity of said trunk can move laterally with respect to said jaw assembly despite said tight engagement, said bar means having a trunk-engaging portion opposing said jaw assembly for engaging the side of said trunk and being attached fixedly to said base at locations on opposite sides of said trunk-engaging portion when locked in bendable engagement with the side of said trunk.

8. The apparatus of claim 7 wherein said bar means is formed of bendable plastic.

9. The apparatus of claim 7 wherein said trunk-engaging portion of said bar means is formed nonlinearly so as to include an obtuse angle.

10. The apparatus of claim 7 wherein said bar means is pivotally mounted to said base at one end of said trunk-engaging portion.

11. The apparatus of claim 7 including locking means for slidably engaging said bar means with said base and selectively fixedly interconnecting said bar means with said base at different slidable locations along said base.

12. The apparatus of claim 7 wherein said jaw assembly includes a bottom portion slidably engageable with said trunk so as to permit said trunk to slide laterally across said bottom portion of said jaw assembly.

13. A method of supporting the trunk of a Christmas tree on a stand having a jaw assembly for laterally supporting said trunk by engaging the side thereof, said jaw assembly having a bottom portion, and a bar located above said bottom portion of said jaw assembly for laterally supporting said trunk by engaging the side thereof, said method comprising:

(a) inserting said trunk between said jaw assembly and said bar;

(b) forcibly moving said bar laterally into tight engagement with the side of said trunk so as to engage said trunk tightly between said bar and jaw assembly, and locking said bar in said tight engagement; and (c) thereafter grasping said trunk at a position above said bar and thereby moving said trunk laterally so as to cause said trunk to pivot about said bar and cause said trunk at a position below said bar to slide laterally across said bottom portion of said jaw assembly to straighten said tree.

14. The method of claim 13 wherein step (b) comprises moving said bar into said tight engagement by applying foot pressure against said bar.

15. The method of claim 13 wherein step (b) comprises resiliently bending said bar as it engages said trunk.

* * * * *

UNITED STATES PATENT AND TRADEMARK OFFICE

CERTIFICATE OF CORRECTION

PATENT NO. : 5,375,808

DATED : December 27, 1994

INVENTOR(S) : Michael E. Roy

It is certified that error appears in the above-identified patent and that said Letters Patent is hereby corrected as shown below:

Column 1, Line 19: Delete "or" and insert --of--.

Signed and Sealed this

Twenty-fifth Day of April, 1995

Bruce Lehman

*Attest:*

BRUCE LEHMAN

*Attesting Officer*

*Commissioner of Patents and Trademarks*